US006064287A

United States Patent [19]

Jones

[11] Patent Number: 6,064,287

[45] Date of Patent: May 16, 2000

[54] WAVEGUIDE WITH SELF-PRESSURIZING DEHYDRATOR

[75] Inventor: Thaddeus M. Jones, Bremen, Ind.

[73] Assignee: MSX, Inc., South Bend, Ind.

[21] Appl. No.: 08/959,476

[22] Filed: Oct. 28, 1997

[51] Int. Cl.[7] ..... H01P 1/30

[52] U.S. Cl. ..... 333/248; 333/99 R; 96/138

[58] Field of Search ..... 333/248, 99 R; 96/138

[56] References Cited

U.S. PATENT DOCUMENTS 2,845,138 7/1958 Gageby ..... 96/138 X 4,504,289 3/1985 Waller ..... 96/103

4,594,082 6/1986 Catherwood, Sr. ..... 96/138

4,694,267 9/1987 Guill et al. ..... 333/248

*Primary Examiner*—Benny Lee

*Attorney, Agent, or Firm*—Taylor & Aust, P.C.

[57] ABSTRACT

An antenna system includes a substantially enclosed waveguide and a container including an inlet and an outlet. The inlet is fluidly connected to ambient air. The outlet is fluidly connected to the waveguide. A check valve is disposed within the container. The check valve is configured for allowing air passage from the inlet to the outlet while preventing air passage from the outlet to the inlet. A desiccant is disposed within the container.

23 Claims, 2 Drawing Sheets

WAVEGUIDE WITH SELF-PRESSURIZING DEHYDRATOR

BACKGROUND OF THE INVENTION

1. Field of the Invention

The present invention relates to satellite systems, and, more particularly, to waveguides for use with satellite systems.

2. Description of the Related Art

A waveguide is a device which constrains or guides the propagation of electromagnetic waves along a path defined by the physical construction of the waveguide. More specifically, a waveguide usually includes a metallic tube which can confine and guide the propagation of electromagnetic waves in the lengthwise direction of the tube. In satellite systems, a waveguide is used as a conduit for the transmission of communication signals between the feedhorn of a satellite dish and the electronics of the satellite system, such as a transceiver. A satellite dish and associated feedhorn are typically placed outdoors. Consequently, portions of the waveguide which lead to the feedhorn may also be located outdoors.

It is known to substantially seal a waveguide to prevent outside moisture from entering and condensing within the waveguide. Water droplets within a waveguide can cause corrosion and signal losses resulting in an unacceptable degradation in performance. It is also possible for water within a waveguide to damage the system electronics.

A problem with conventional waveguides is that moist air still sometimes penetrates a waveguide and condenses therein. This penetration of moist air into the waveguide may occur when the outside atmospheric pressure undergoes a relatively sudden increase. The inside of the waveguide remains at the former lower atmospheric pressure. Hence, the pressure difference between the outside and the inside of the waveguide may force air from the outside, which can be moist, through any small cracks or holes in the waveguide. Such small openings in the waveguide can be otherwise airtight under normal pressure conditions.

It is also known to pressurize the inside of a waveguide with a mechanical air pump in order to inhibit ambient air from entering the waveguide. A problem is that air will leak out of the pressurized waveguide into the ambient environment, just as air penetrates the waveguide as described above when ambient pressure is higher than pressure within the waveguide. As air leaks out of the waveguide over some period of time, pressure within the waveguide substantially equalizes with ambient pressure. When ambient pressure eventually rises, ambient air may again be forced into the waveguide, causing the same problems discussed above. For this reason, the waveguide must be repressurized rather frequently.

It is further known to provide a waveguide with a port or hole fluidly connected to a bottle containing a desiccant or drying agent for dehumidifying the air within the waveguide. The bottle contains a single opening which is fluidly connected with the waveguide port. A problem is that the desiccant can relatively quickly become saturated with moisture from the air within the waveguide. When saturated, the desiccant no longer effectively absorbs moisture from the air within the waveguide and must be replaced often, or at least dried out for subsequent use.

What is needed in the art is a waveguide which inhibits moist air from entering therein, even under extreme atmospheric conditions, and does not need frequent maintenance.

SUMMARY OF THE INVENTION

The present invention provides a low-maintenance waveguide into which only dry air is allowed to enter, and the inside of which is maintained at an air pressure higher, on average, than outside atmospheric pressure.

The invention comprises, in one form thereof, an antenna system including a substantially enclosed waveguide and a container including an inlet and an outlet. The inlet is fluidly connected to ambient air. The outlet is fluidly connected to the waveguide. A check valve is disposed within the container. The check valve is configured for allowing air passage from the inlet to the outlet while preventing air passage from the outlet to the inlet. A desiccant is disposed within the container.

An advantage of the present invention is that substantially all moisture is removed from air entering the waveguide.

Another advantage is that the waveguide is maintained at a higher pressure, on average, than atmospheric pressure so that moist air is not forced from the outside into the waveguide through minute openings.

Yet another advantage is that the waveguide does not need to be periodically pressurized with a pump.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
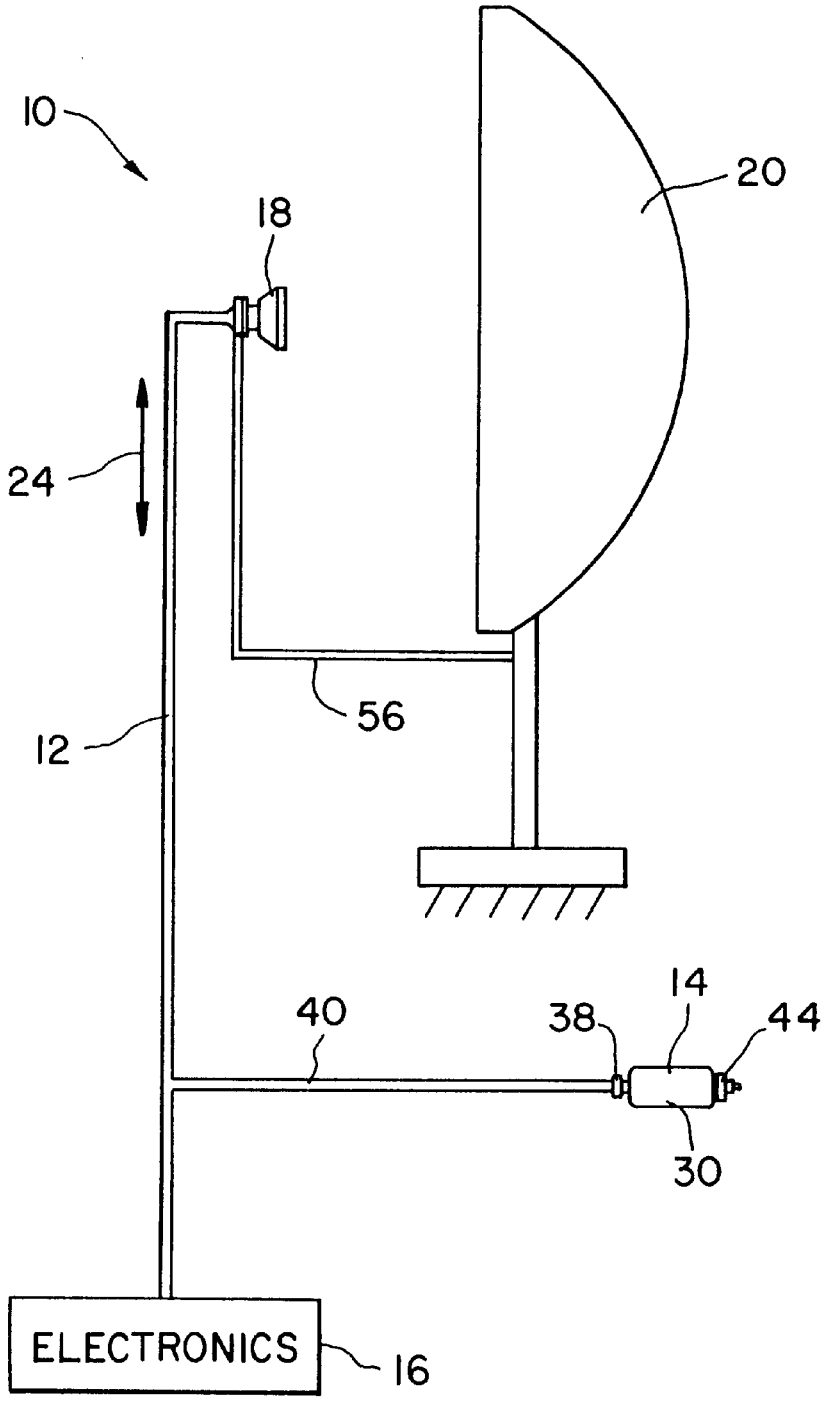
FIG. 1 is a schematic view of one embodiment of a waveguide with self-pressurizing dehydrator of the present invention in a satellite system.

Referring now to the drawings, there is shown in FIG. 1 an antenna system 10 including a waveguide 12, self-pressurizing dehydrator 14, system electronics 16, and a feedhorn 18 associated with a satellite dish 20.

Figure 2:
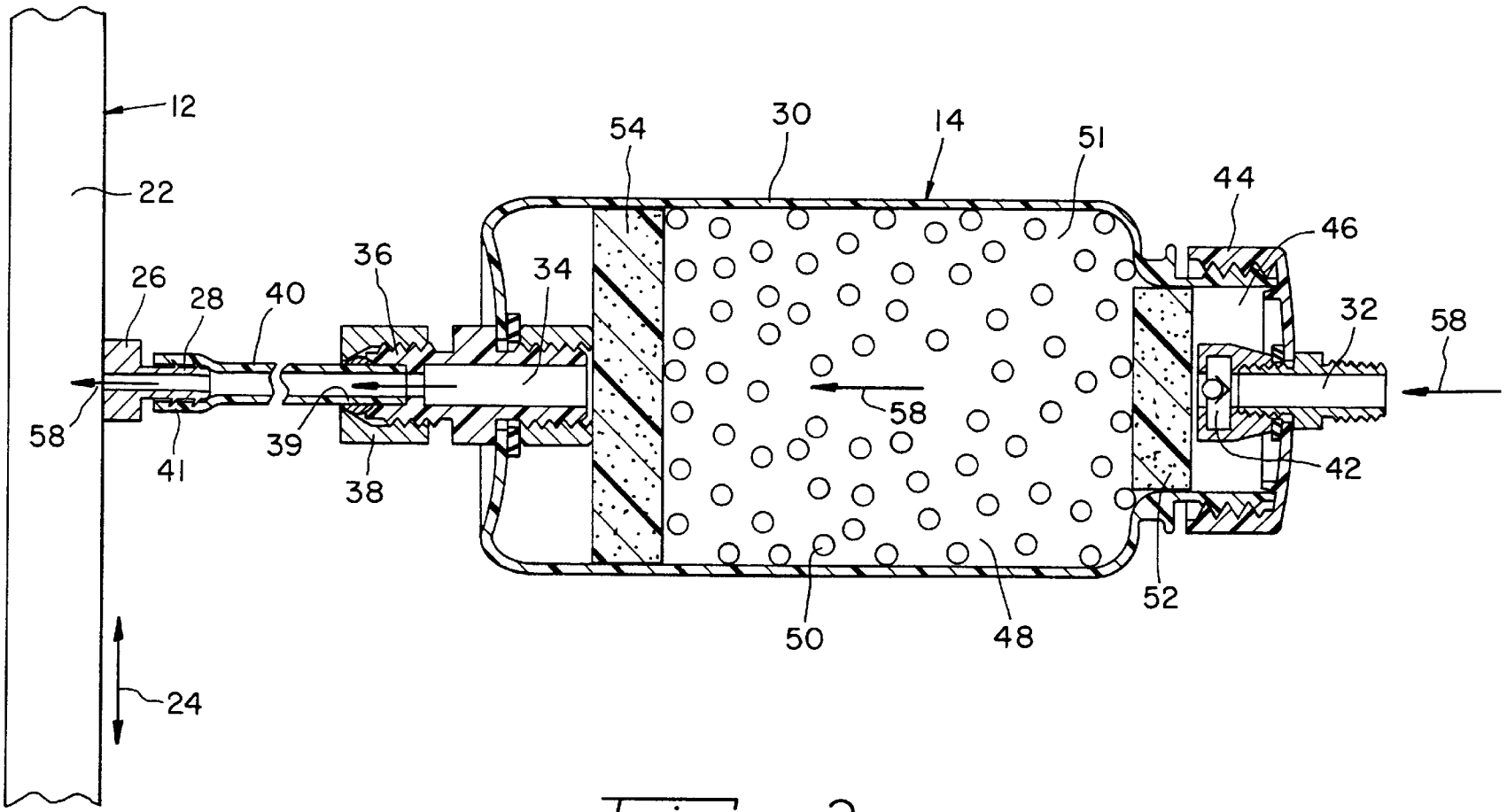
FIG. 2 is an enlarged, side, sectional view of the waveguide with self-pressurizing dehydrator shown in FIG. 1.

Waveguide 12 is an elongate conduit or tube which confines and guides the propagation of communication signals between feedhorn 18 and system electronics 16. As shown in FIG. 2 waveguide 12 has a hollow inside 22 which allows the propagation of electromagnetic waves in the lengthwise direction of the tube, indicated by double arrow 24 (also shown in FIG. 1). Waveguide 12 has a port 26 with a barbed fitting 28 leading to the ambient environment. With the exception of port 26, waveguide 12 is substantially enclosed to inhibit air from flowing between waveguide 12 and the ambient environment.

System electronics 16 (FIG. 1) can include a transmitter-receiver, also known as a transceiver. System electronics 16, like almost all electronics, can be damaged by excessive moisture.

Feedhorn 18 is connected to satellite dish 20 through support 56 (FIG. 1). Although shown schematically in FIG. 1, waveguide 12 may lie substantially coincident with an axis of rotation of satellite dish 20. A rotatable coupling (not shown) can be used to interconnect waveguide 12 with satellite dish 20 such that satellite dish 20 is free to rotate about the axis of rotation.

As best seen in FIG. 2 dehydrator 14 inhibits moisture from entering waveguide 12 and therein causing corrosion and signal loss. Dehydrator 14 includes a container 30 (also shown in FIG. 1) including an inlet 32 and an outlet 34. Inlet 32 leads to and is fluidly connected to the ambient environment or ambient air. Inlet 32 is formed as part of a threaded lid 44 (also shown in FIG. 1) which screws over a threaded mouth 46 on one end of container 30. Outlet 34 leads to a threaded connector 36 onto which a threaded coupling 38 is screwed. Coupling 38 (also shown in FIG. 1) secures one end 39 of a hose 40 to connector 36, while the other end 41 of hose 40 receives barbed fitting 28 of waveguide port 26. In this way, hose 40 (also shown in FIG. 1) fluidly interconnects waveguide 12 and outlet 34 of container 30.

Desiccant 48, in the form of pellets 50 with a relatively small amount of fine powder or fines, substantially fills any unoccupied space within a middle portion 51 of container 30. Desiccant 48 acts as a drying agent which absorbs or abstracts moisture from the air flowing therethrough.

A check valve 42, shown in simplified schematic form, is disposed within inlet 32. Check valve 42 allows air to flow from inlet 32 to outlet 34 of container 30, but does not allow air to flow in the opposite direction from outlet 34 to inlet 32. Check valve 42 is configured to allow air passage from inlet 32 to outlet 34 when ambient air pressure is 0.1 pounds/inch$^2$ (PSI) higher than air pressure within waveguide 12. Of course, check valve 42 can alternatively be configured to open at other pressure differentials. In one embodiment, check valve 42 is a Part No. 214/224 PB-3, manufactured by Smart Products, Inc., 1710 Ringwood Ave., San Jose, Calif. 95131. Check valve 42 is shown as being disposed within inlet 32; however, check valve 42 can also be placed in a tube leading to inlet 32. In either location, check valve 42, when closed, seals desiccant 48 from the moisture of the ambient environment. In this way, check valve 42 protects desiccant 48 from the oversaturation which degrades its ability to absorb further moisture. It is also possible, however, to place check valve 42 within outlet 34, or in tube 40 leading from outlet 34.

Separators 52 and 54 retain desiccant pellets 50 within middle portion 51 of container 30, and prevent desiccant pellets 50, and fine materials which may have leaked out of pellets 50, from clogging either inlet 32 or outlet 34. A first, smaller separator 52 is sized to fit within mouth 46 of container 30 between check valve 42 and desiccant 48. First separator 52 prevents desiccant pellets 50 from obstructing the check valve mechanism as well as shielding inlet 32 from pellets 50. A second, larger separator 54 is on the outlet side of container 30 between desiccant 48 and outlet 34. Second separator 54 prevents desiccant pellets 50 from entering outlet 34.

Separators 52 and 54 are formed of foam rubber in the embodiment shown; however, any suitable material which filters small objects such as pellets 50 from an air flow or passage can be used. For instance, separators 52, 54 can be in the form of wire screens with a mesh sized to retain pellets 50 and associated fines.

Although dehydrator 14 is shown as being connected to waveguide 12, dehydrator 14 can also be used to pressurize and dehumidify any type of substantially enclosed vessel.

In the embodiment shown, lid 44 of container 30 is disposed at the inlet side of dehydrator 14, and check valve 42 is connected to lid 44. However, it will appreciated that lid 44 may also be disposed at the outlet side of container 30 and/or check valve 42 may be connected to the end of container 30 opposite lid 44. Of course, check valve 42 is oriented to establish a pressure differential in the proper flow direction regardless of where check valve 42 is located.

In use, check valve 42 opens to allow air to flow from the ambient air at inlet 32 to waveguide 12, as indicated by arrows 58. Check valve 42 opens when the ambient atmospheric or barometric pressure is more than 0.1 PSI higher than the air pressure within waveguide 12. En route, the air flows through container 30 in close proximity to desiccant pellets 50. Desiccant 48 removes substantially all moisture from the air before it enters waveguide 12. Air flow from the ambient environment into waveguide 12 continues until air pressure within waveguide 12 is substantially equal to ambient air pressure. At this point, when ambient air pressure is approximately equal to air pressure within waveguide 12, check valve 42 closes, substantially sealing the dry air within waveguide 12 from the ambient environment. When check valve 42 is closed, substantially sealing waveguide 12, air pressure within waveguide 12 varies linearly with the air temperature within waveguide 12. When the air temperature within waveguide 12 falls, the air pressure within waveguide 12 also falls since waveguide 12 is substantially enclosed. In the event that the air temperature within waveguide 12 falls while ambient air pressure remains constant, air pressure within waveguide 12 can fall below ambient air pressure. Check valve 42 will open when ambient air pressure exceeds air pressure within waveguide 12 by 0.1 PSI. It has been found that this air pressure difference of 0.1 PSI corresponds to an approximately 3° F. temperature drop within waveguide 12. In other words, given a constant ambient air pressure and an initial air pressure within waveguide 12 which is equal to the ambient pressure, check valve 42 is configured to open after an approximately 3° F. temperature drop within waveguide 12. For instance, assume waveguide 12 is initially sealed by check valve 42 at atmospheric pressure at 60° F. If the temperature within waveguide 12 falls to 57° F. while atmospheric pressure remains constant, air pressure within the enclosed waveguide 12 will fall approximately 0.1 PSI below outside atmospheric pressure and check valve 42 will open. Check valve 42 will remain open until the air pressure within waveguide 12 is approximately equal to atmospheric pressure, at which point check valve 42 will close, again sealing waveguide 12 at atmospheric pressure. This cycle will continue so long as the temperature within waveguide 12 continues to fall. Conversely, if the temperature within waveguide 12 rises, then the pressure within waveguide 12 also rises since waveguide 12 defines a substantially closed system. Air pressure within waveguide 12 will be greater than a constant atmospheric pressure by approximately 0.1 PSI for each 3° F. of temperature rise above the temperature at which waveguide 12 was last sealed. For instance, if check valve 42 last sealed waveguide 12 at atmospheric pressure at 50° F., and the temperature within waveguide 12 is now 80° F., then the air pressure within waveguide 12 will be approximately 1 PSI [(80° F.–50° F.)×0.1 PSI/3° F.] greater than atmospheric pressure. Assuming no leakage of air from waveguide 12, the air pressure within waveguide 12 will be greater than the atmospheric pressure at which waveguide was last sealed so long as the temperature within waveguide 12 is greater than the temperature at which waveguide 12 was last sealed.

During the temperature variations described above, air pressure within waveguide 12 is usually above ambient air pressure since waveguide seals at the last lowest atmospheric temperature to which it was exposed. Thus, check valve 42 maintains air pressure inside waveguide 12 higher, on average, than ambient air pressure. Similarly, desiccant 48 maintains humidity inside waveguide 12 lower, on average, than ambient air humidity. Check valve 42 is shown as opening when ambient air pressure is greater than 0.1 PSI above the air pressure within waveguide 12. However, it is to be understood that check valve 42 can be configured to open when ambient air pressure exceeds air pressure within the waveguide 12 by substantially any desired or predetermined amount. In other words, check valve 42 can be selected to be either more or less sensitive to temperature drops within waveguide 12.

In the event that ambient air pressure drops, waveguide 12, by virtue of its enclosed structure and the sealing effect of check valve 42, remains at the higher air pressure at which check valve 42 last closed. Depending upon how well sealed or enclosed waveguide 12 is, waveguide 12 can retain this higher than ambient air pressure for a substantial period of time. If ambient air pressure again rises at least 0.1 PSI above the air pressure within waveguide 12, check valve 42 will again open, allowing air to flow from the ambient environment into waveguide 12.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A waveguide assembly, comprising:

a waveguide, said waveguide being substantially enclosed in order to inhibit air from flowing between said waveguide and ambient air;

a container separate from said waveguide, said container including an inlet and an outlet, said inlet fluidly connected to the ambient air, said outlet fluidly connected to said waveguide;

a check valve disposed within said container, said check valve allowing air passage from said inlet to said waveguide while preventing air passage from said waveguide to said inlet; and a desiccant disposed within said container.

2. The waveguide assembly of claim 1, wherein said check valve and said desiccant prevents moisture from entering said waveguide.

3. The waveguide assembly of claim 1, wherein said check valve maintains air pressure inside said waveguide higher, on average, than ambient air pressure.

4. The waveguide assembly of claim 1, wherein said waveguide includes a port fluidly connected to said outlet.

5. The waveguide assembly of claim 1, wherein said check valve is configured to open after an approximately 3° F. temperature drop within said waveguide.

6. The waveguide assembly of claim 1, wherein said check valve is configured to open when ambient air pressure is greater than air pressure within said waveguide by a predetermined amount.

7. The waveguide assembly of claim 6, wherein said predetermined amount is 0.1 pounds per square inch.

8. The waveguide assembly of claim 6, wherein said check valve is configured to close when ambient air pressure is approximately equal to air pressure within said waveguide, said check valve thereafter being closed.

9. The waveguide assembly of claim 6, wherein said check valve is configured to close when the ambient air temperature is approximately equal to the temperature within said waveguide, said check valve thereafter being closed.

10. The waveguide assembly of claim 1, further comprising at least one separator disposed within said container, said at least one separator being configured for separating said desiccant from at least one of said inlet said outlet and said check valve.

11. The waveguide assembly of claim 10, wherein said at least one separator comprises at least one piece of foam rubber.

12. The waveguide assembly of claim 1, wherein said check valve is disposed within said inlet, thereby substantially sealing said desiccant from ambient air when said check valve is closed.

13. The waveguide assembly of claim 12, further comprising a first separator disposed between said check valve and said desiccant.

14. The waveguide assembly of claim 13, further comprising a second separator disposed between said desiccant and said outlet.

15. The waveguide assembly of claim 1, wherein said check valve is disposed within said outlet.

16. The waveguide assembly of claim 1, wherein said desiccant maintains humidity inside said waveguide lower, on average, than ambient humidity.

17. The waveguide assembly of claim 1, wherein said check valve is configured to open when a temperature within said waveguide is less than an ambient air temperature by a predetermined amount.

18. The waveguide assembly of claim 1, wherein said check valve is configured to be closed when ambient air pressure is less than 0.1 pounds per square inch greater than air pressure within said waveguide.

19. The waveguide assembly of claim 1, wherein said check valve is configured to be closed when the temperature within said waveguide does not fall below approximately 3° F. less than the ambient temperature.

20. A dehydrating system, comprising:

a vessel, said vessel being substantially enclosed in order to inhibit air from flowing between said vessel and ambient air;

a container separate from said vessel, said container including an inlet and an outlet, said inlet fluidly connected to the ambient air, said outlet fluidly connected to said vessel;

a check valve disposed within said container, said check valve allowing air passage from said inlet to said vessel while preventing air passage from said vessel to said inlet; and a desiccant disposed within said container.

21. A dehydrating system, comprising:

a vessel, said vessel being substantially enclosed in order to inhibit air from flowing between said vessel and ambient air;

a container separate from said vessel, said container including an interior, an inlet and an outlet, said inlet fluidly connected to the ambient air, said outlet fluidly connected to said vessel;

a check valve connected with said container and in fluid communication with said container interior, said check valve allowing air passage from the ambient air to said vessel while preventing air passage from said vessel to the ambient air; and a desiccant disposed within said container.

22. The dehydrating system of claim 21, wherein said check valve is configured to open when ambient air pressure is greater than air pressure within said vessel by a predetermined amount.

23. The dehydrating system of claim 21, wherein said check valve is configured to open when a temperature within said vessel is less than an ambient air temperature by a predetermined amount.

* * * * *